United States Patent [19]

Takenoya et al.

[11] 4,303,028

[45] Dec. 1, 1981

[54] SEWING MACHINE WITH NEEDLE DROPPING HOLE CHANGING CONTROL SYSTEM

[75] Inventors: Hideaki Takenoya, Hachioji; Hachiro Makabe, Fussa, both of Japan

[73] Assignee: Janome Sewing Machine Co., Ltd., Tokyo, Japan

[21] Appl. No.: 6,684

[22] Filed: Jan. 26, 1979

[30] Foreign Application Priority Data

| | | | |
|---|---|---|---|
| Jan. 26, 1978 | [JP] | Japan | 53-7680 |
| Jul. 3, 1978 | [JP] | Japan | 53-90477[U] |
| Oct. 26, 1978 | [JP] | Japan | 53-131014 |

[51] Int. Cl.[3] ..... D05B 3/02

[52] U.S. Cl. ..... 112/158 E

[58] Field of Search ..... 112/158 E, 158 R, 260

[56] References Cited

U.S. PATENT DOCUMENTS

| | | | |
|---|---|---|---|
| 3,552,337 | 1/1971 | Hanyu et al. | 112/158 R |
| 3,830,175 | 8/1974 | Levor | 112/121.12 |
| 4,048,932 | 9/1977 | Odermann et al. | 112/158 E |
| 4,103,632 | 8/1978 | Bowles | 112/158 E |

*Primary Examiner*—Peter P. Nerbun

*Attorney, Agent, or Firm*—Michael J. Striker

[57] ABSTRACT

A sewing machine is disclosed in which a needle hole switching mechanism is activated in association with pattern stitch selection.

3 Claims, 22 Drawing Figures

ⓐ Pattern selecting device
ⓑ Pulse generator
ⓒ Control circuit
ⓓ Pulse motor driving circuit
ⓔ Pulse motor

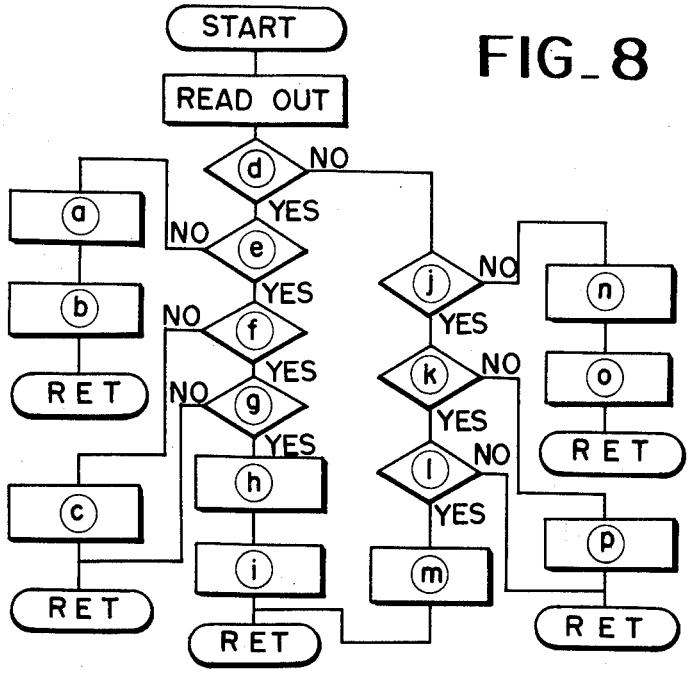

FIG_8

ⓐ High speed rotation of machine

ⓑ Performance of previous pattern program

ⓒ Low speed rotation of machine

ⓓ Straight stitching or not ?

ⓔ Previous stitching or not ?

ⓕ Low speed rotation of machine or not?

ⓖ Needle position is above needle plate or not ?

ⓗ Pulse motor is driven to change zigzag stitching needle hole to straight stitch needle hole ⓘ Previously selected stitch is changed to lastly selected stitch ⓙ Previous stitching or not ?

ⓚ Low speed rotation of machine or not ?

ⓛ Needle position is above needle plate or not ?

ⓜ Pulse motor is driven to change straight stitch needle hole to zigzag stitch needle hole and performance of lastly selected pattern program ⓝ High speed rotation of machine ⓞ Performance of previous pattern program ⓟ Low speed rotation of machine ⓐ Pattern selecting device
ⓑ Pulse generator
ⓒ Control circuit
ⓓ Pulse motor driving circuit
ⓔ Pulse motor
ⓕ Solenoid driving circuit
ⓖ Solenoid

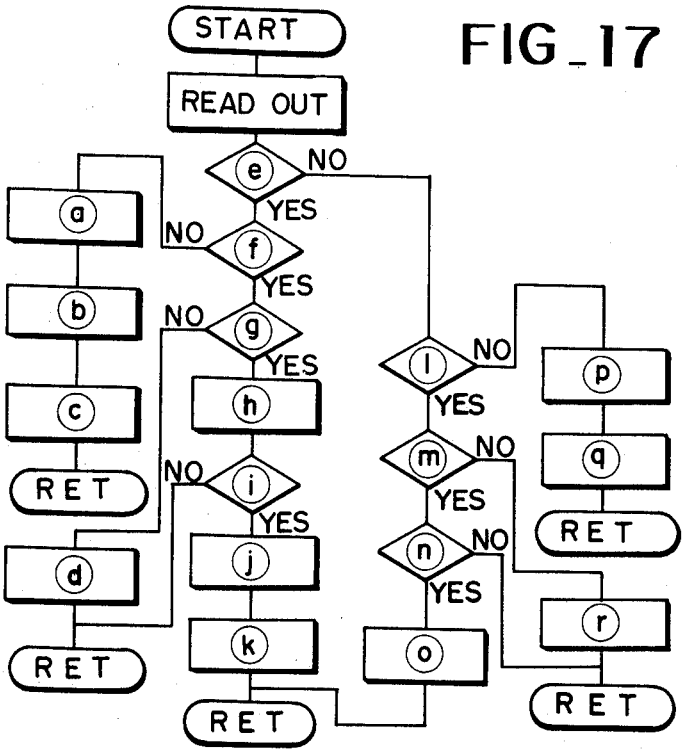

FIG_17

ⓐ High speed rotation of machine
ⓑ Clutch solenoid off
ⓒ Performance of previous pattern program
ⓓ Low speed rotation of machine
ⓔ Straight stitching or not ?
ⓕ Previous stitching or not ?
ⓖ Low speed rotation of machine or not ?
ⓗ Clutch solenoid on
ⓘ Needle position is above needle plate or not?
ⓙ Pulse motor is driven to change zigzag stitching needle hole to straight stitch needle hole
ⓚ Previously selected stitch is changed to lastly selected stitch
ⓛ Previous stitching or not ?
ⓜ Low speed rotation of machine or not ?
ⓝ Needle position is above needle plate or not ?
ⓞ Pulse motor is driven to change straight stitch needle hole to zigzag stitch needle hole and performance of lastly selected pattern program
ⓟ High speed rotation of machine
ⓠ Performance of previous pattern program
ⓡ Low speed rotation of machine

SEWING MACHINE WITH NEEDLE DROPPING HOLE CHANGING CONTROL SYSTEM

BACKGROUND OF THE INVENTION

This invention relates to a control device for a needle hole switching mechanism in a needle plate in a sewing machine, in which machine the lateral swing amplitude of the needle bar is electrically controlled by an electric driving device for forming stitched patterns, in which machine actuation of the needle hole switching mechanism is regulated by selecting members to change the configuration of the needle hole to conform with the shape required for zigzag stitches or straight stitches in accordance with an operator's requirements, and in which machine the feed dog is caused to drop down under the needle plate to allow manual stitching.

Conventional sewing machines, provided with mechanical pattern generating devices require that when the patterns are changed from zigzag stitches to straight stitches, the lateral swing amplitude of the needle is reduced zero and maintained at that value, and the needle hole is made to conform to straight stitches. In changing the machine pattern from straight stitches to zigzag stitches, these steps are reversed. Such operations are troublesome to the operator of the sewing machine.

SUMMARY OF THE INVENTION

The present invention has been devised to eliminate such faults and disadvantages of the prior art.

It is a first object of the invention to provide automatic control of the needle hole mechanism in the needle plate to correspond to the patterns to be stitched, to thereby simplify machine adjustment.

It is a second object of the invention to provide a needle hole mechanism which does not require independent operation, to thereby prevent needle breakage.

It is a third object of the invention to construct a small structure which will be physically small.

Other features will become apparent from the following explanation of the embodiments of the invention, which explanation refers to the attached drawings.

BRIEF DESCRIPTION OF THE DRAWINGS

FIG. 8 shows a flow chart used in the control circuit;

FIG. 17 shows a flow chart used in the control circuit of FIG. 16;

DETAILED DESCRIPTION OF PREFERRED EMBODIMENTS

Figure 1:
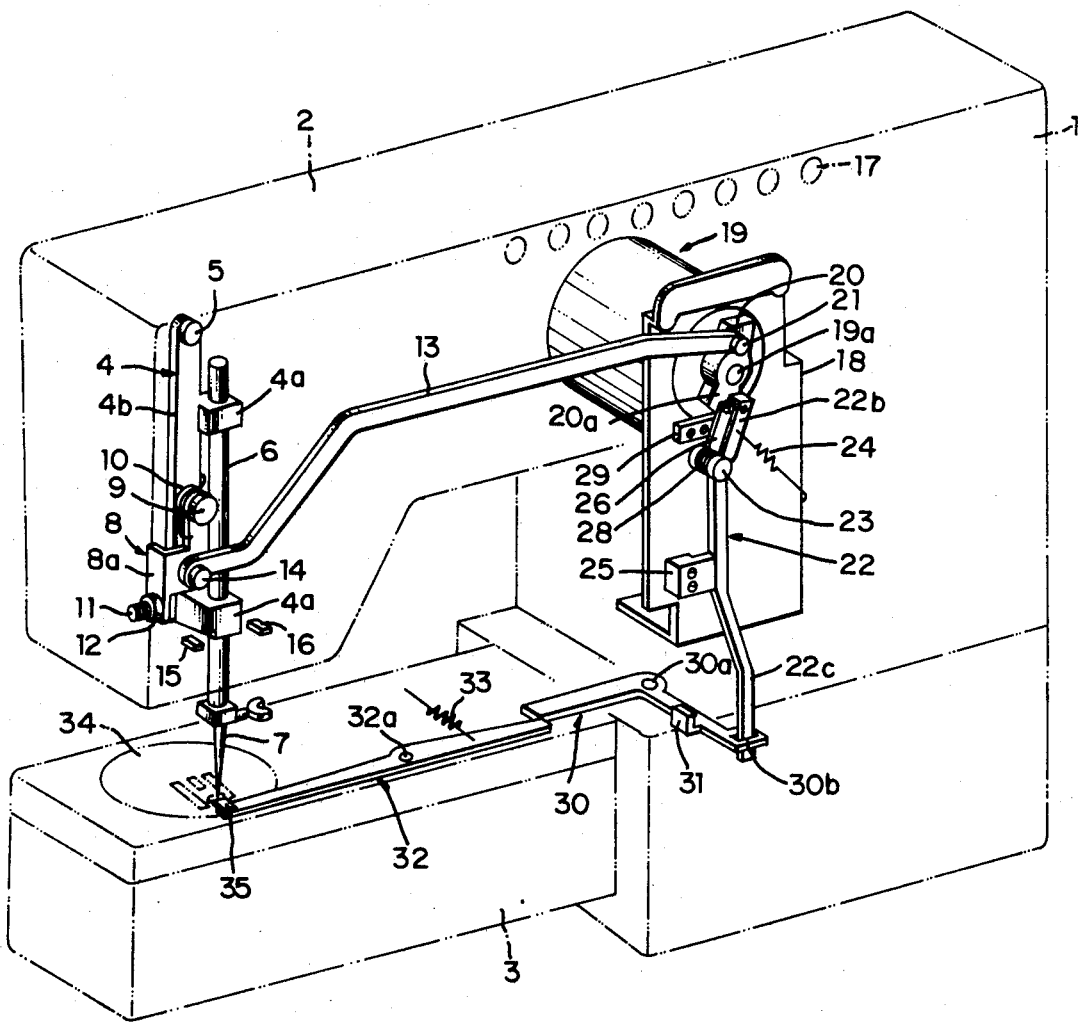
FIG. 1 shows a perspective view of a sewing machine the invention installed therein.

In FIGS. 1–6, reference numeral 1 designates a sewing machine having an arm housing 2 and a bed frame 3. A needle bar supporter 4 is provided, for generating zigzag stitches, and has an upper end which is pivotally secured to arm housing 2 with a pin 5. Side wall 4*a* of needle bar supporter 4 holds a needle bar 6 vertically for vertical reciprocation, needle bar 6 being fixedly secured at its bottom end to needle 7. A connecting plate 8 is pivotally secured to a meddle part of needle bar supporter 4 by a pin 9, and has piece 8*a* which faces a left side 4*b* of needle bar supporter 4 and supports stop screw 11.

A spring 10 is wound on the pin 9. One end of spring 10 engages needle bar supporter 4 and the other end engages connecting plate 8. Stop screw 11 is secured to piece 8*a* by a nut 12 so that the end of stop screw 11 is always engaged with the left side 4*b* by means of spring 10, so that needle bar supporter 4 and connecting plate 8 always move together. A rod 13 is pivoted to plate 8 with a pin 14 to enable needle bar supporter 4 to be moved laterally. Stop 15 and 16 are fixed to arm housing 2 for limiting lateral and motion of needle bar 6.

Left stop 15 is disposed at such a position that it touches needle bar 6 when it comes to the leftmost extreme of its lateral range. i.e., the left basic line, and right stop 16 is disposed at such a position that it touches the needle bar 6 when it comes to the rightmost extreme of its lateral range, i.e., the right basic line. A plurality of pattern selectors 17 are arranged within a pattern selecting device shown in FIG. 7.

A block 18 is fixed to arm housing 2, and an electric driver 19 (which, in this embodiment, is a pulse motor) is mounted on the block in to enable lateral motion of needle bar 6 to take place.

A link 20 is secured to a motor shaft 19*a* of the pulse motor 19, and is also secured to an end of rod 13. When link 20 is rotated by pulse motor 19, needle bar 6 moves laterally via cooperation between rod 13, connecting plate 8 and needle bar supporter 4. Segment 20*a* is defined at the lower part of the link 20.

Figure 2:
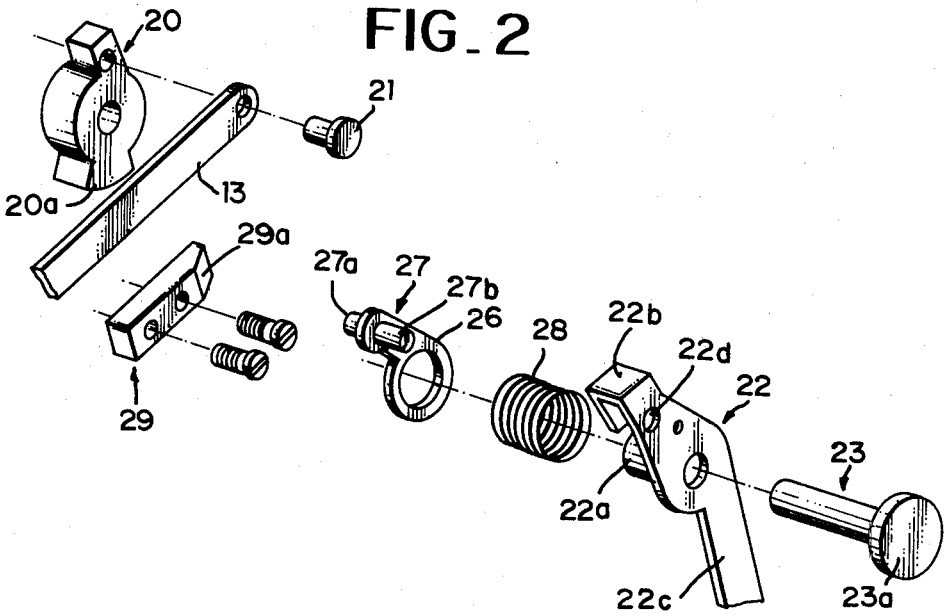
FIG. 2 shows perspective views of partially dissembled of the invention.
Figure 3:
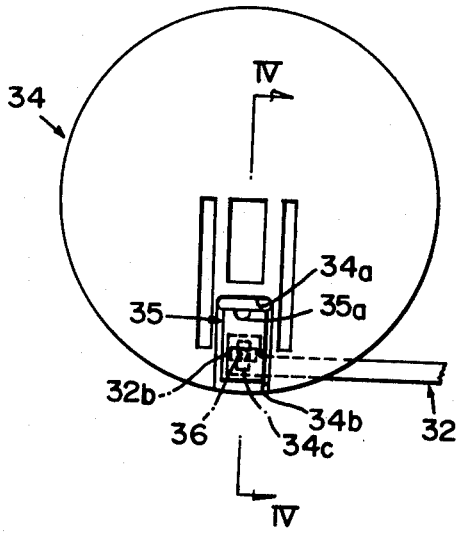
FIG. 3 is a plane view illustrating the relationship between a needle plate and an auxiliary plate thereof.
Figure 4:
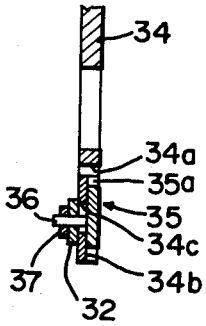
FIG. 4 is a cross-sectional view along line IV—IV in FIG. 3.
Figure 5:
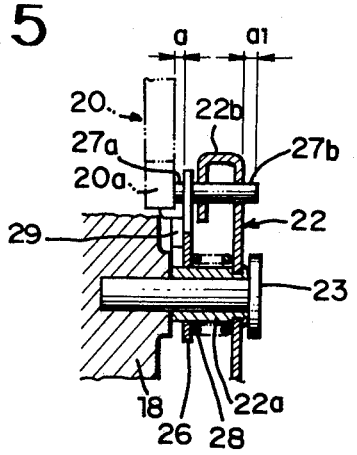
FIG. 5 is a cross-sectional view illustrating the relationship between a lateral amplitude link, a switching plate and an engaging piece.

Referring now to FIG. 2, it can be seen that switching plate 22 is mounted on a pivot shaft 23, which is secured to block 18. Plate 22 has a hollow cylindrical bushing 22*a*, and is restrained in axial movement by a flange 23*a* located at the outermost and of the pivot shaft 23. The switching plate is bent into a U-shape at its upper part to define a bent part 22b, and has a lower erect part 22c.

A coiled tension spring 24 shown in FIG. 1 is arranged between the bent part 22b and block 18, by which spring switching plate 22 rotates clockwise around pivot shaft 23, to be finally restrained by a stop 25 secured to block 18. An engaging piece 26 is mounted on bushing 22a between bent portion 22b and block 18, and is provided with an upper engaging pin 27 which supports a backwardly projecting pin 27a and a forwardly projecting pin 27b. Pin 27a engages a segment 20a in a normal turning range and projecting pin 27b is inserted into a hole 22d formed in the bent part 22b. Therefore, the switching plate 22 and the engaging piece 26 rotate together around pivot shaft 23.

Figure 6:
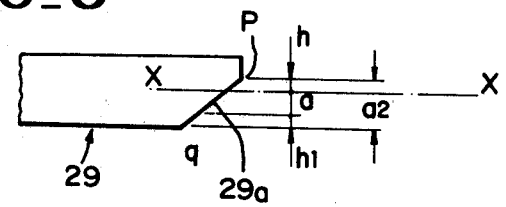
FIG. 6 shows a partially enlarged view of a disengaging piece.

A coiled compression spring 28 is mounted on bushing 22a between switching plate 22 and engaging piece 26. Spring 28 urges pin 27a against segment 20a. In this condition (see FIG. 5), there is created a space "a" between the front of segment 20a and the rear end of engaging piece 26. That is, the length of pin 27a Is equal to a distance of a. Pin 27b is so dimensioned that it extends forwardly from the front end of switching plate 22 by a distance "$a_1$", which is larger than "a". A releasing piece 29 is interposed between block 18 and engaging piece 26, and has at its right end, an oblique portion 29a having a lift "$a_2$" larger than "a" as shown in FIG. 6. Its point "p" starts at a rear (lift "h") than an extension line (x—x) of the front part of the oblique portion 29a and its end point "q" terminates at "$h+a+h_1-a_2$" when engagement between the front end of segment 20a and pin 27a ends, at which time the oblique portion 29a is placed at such a position to push engaging piece 26 forwardly by a "a" distance re-engaging segment 20a and pin 27a shown in FIG. 1.

An L-shaped intermediate lever 30 shown in FIG. 1 is pivotally secured at pivot 30a to bed frame 3 and has a punched hole 30b at one end, into which a vertical lever 22c is placed. Intermediate lever 30 is rotated clockwise around pivot 30a by spring 24 via switching plate 22, and this rotation is limited by a stop 31 secured to bed frame 3. A switching lever 32 is pivotally secured at pivot 32a to bed frame 3 and engages intermediate lever 30 at the right end of switch lever 32. Tension spring 33 is stretched between switching lever 32 and bed frame 3 and serves to rotate switching lever 32 counterclockwise around pivot 32. Needle plate 34 is secured to bed frame 3. Auxiliary plate 35 is slidably mounted in a recess 34b formed in an upper surface of needle plate 34 such that the auxiliary plate 35 faces an elongated needle hole 34a in needle plate 34. A pin 36 extending beneath auxiliary plate 35 is inserted into a punched hole 32b at the left side of switching lever 32. A semicircular needle hole 35a is formed forwardly of elongated needle hole 34a, in auxiliary plate 35. An oblong hole 34c is formed in needle plate 34 for moving pin 36, and a collar 37 surrounds pin 36 to prevent auxiliary plate 35 from slipping off switching lever 32. Therefore, when the switching lever 32 is rotated, auxiliary plate 35 slides within recess 34b in needle plate 34.

Figure 7:
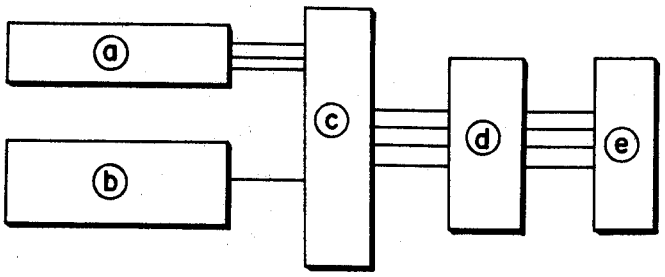
FIG. 7 shows a block diagram of a control circuit for the invention.
Figure 9:
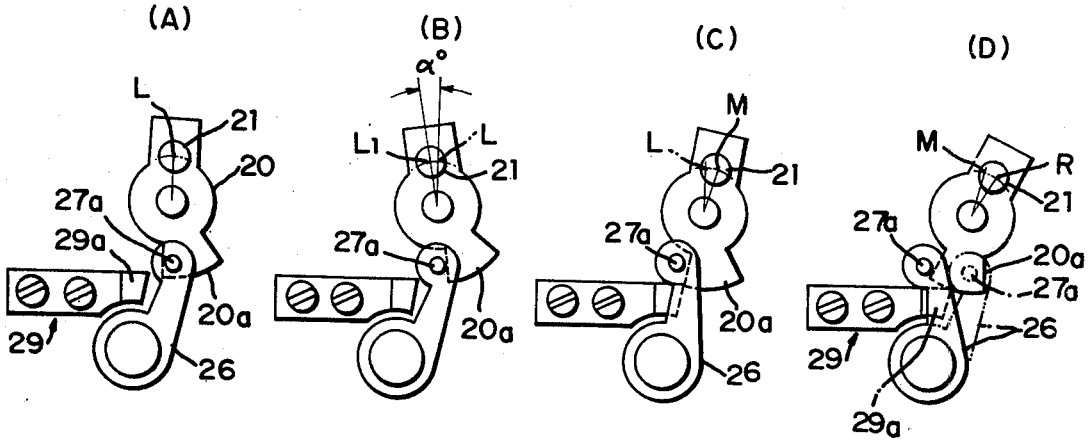
FIG. 9 shows successive operation steps in a part of the invention.
Figure 10:
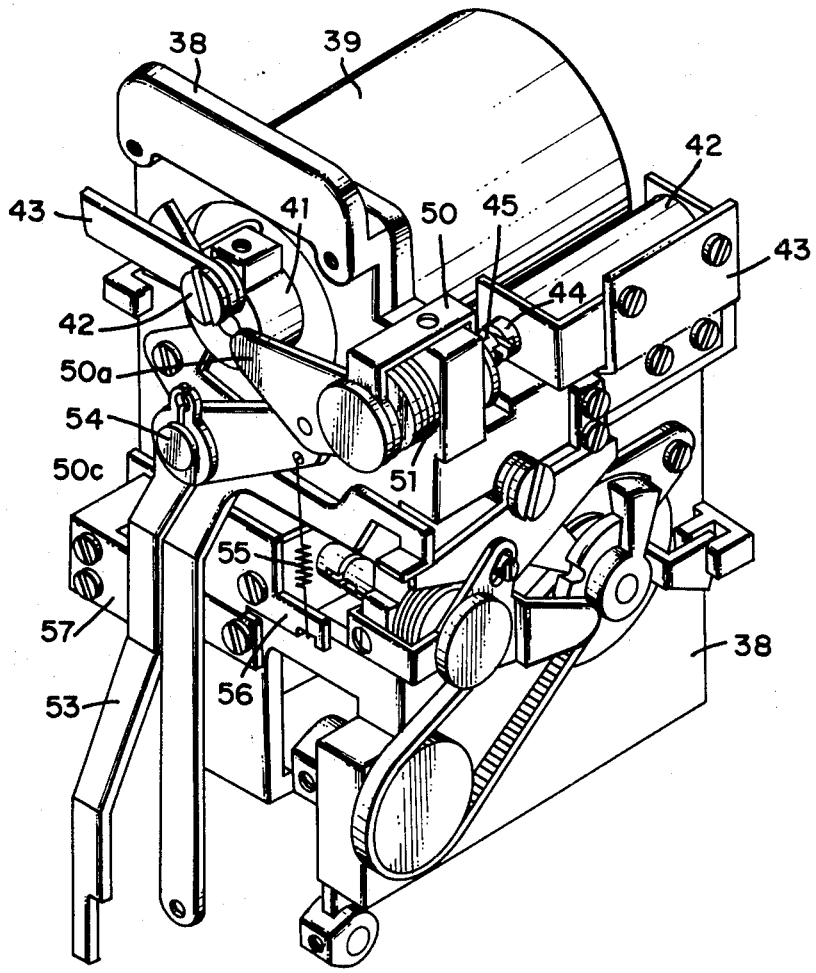
FIG. 10 is a perspective view of a portion of a second embodiment the invention.
Figure 11:
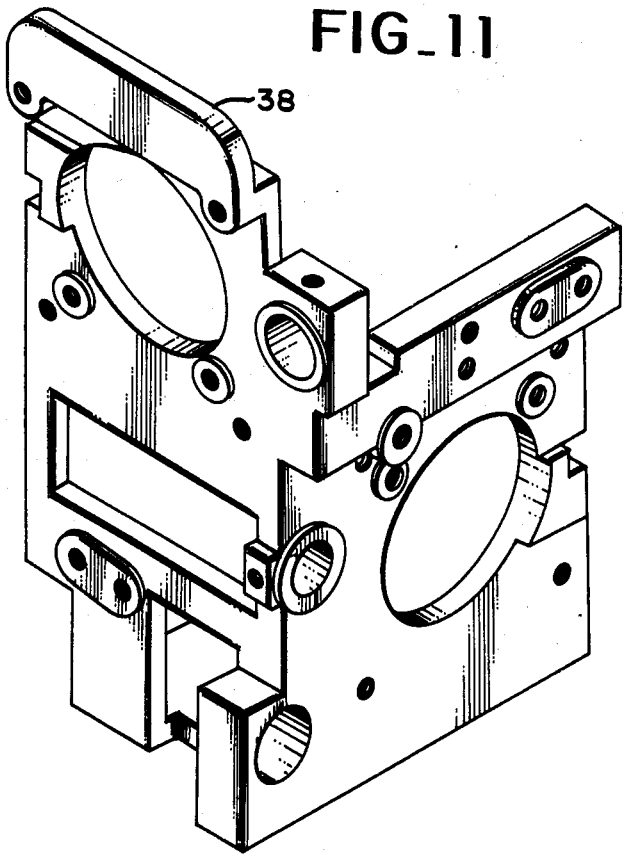
FIG. 11 shows a perspective view of a block body of the embodiment shown in FIG. 10.
Figure 12:
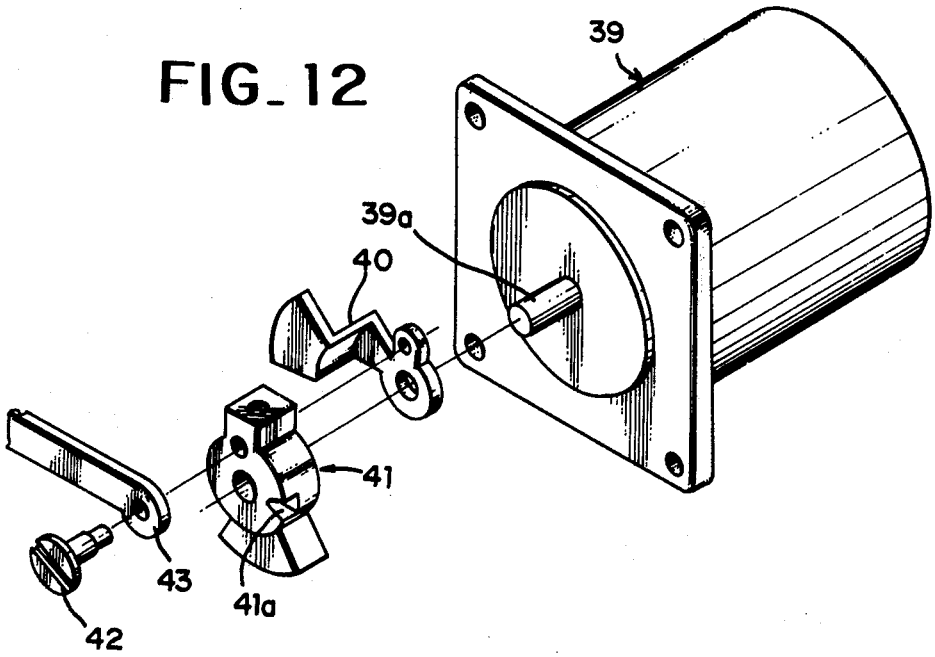
FIG. 12 is a perspective view of a dissembled pulse motor.
Figure 13:
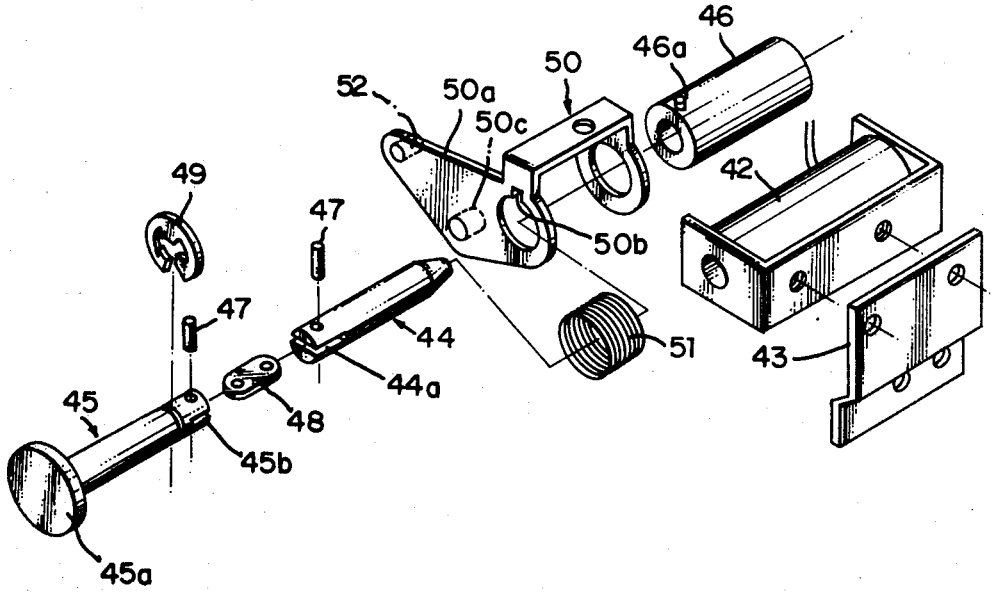
FIG. 13 shows a perspective view of a dissembled clutch used in the second embodiment of the invention.
Figure 15:
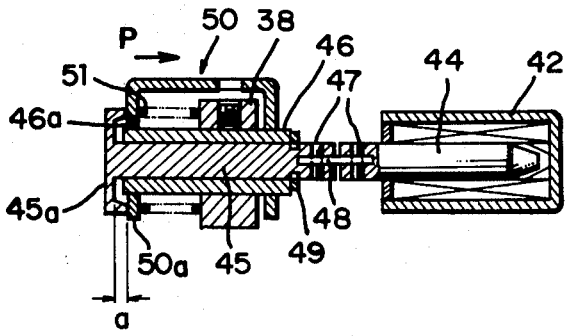
FIG. 15 shows a cross sectional view of a set clutch solenoid.
Figure 14:
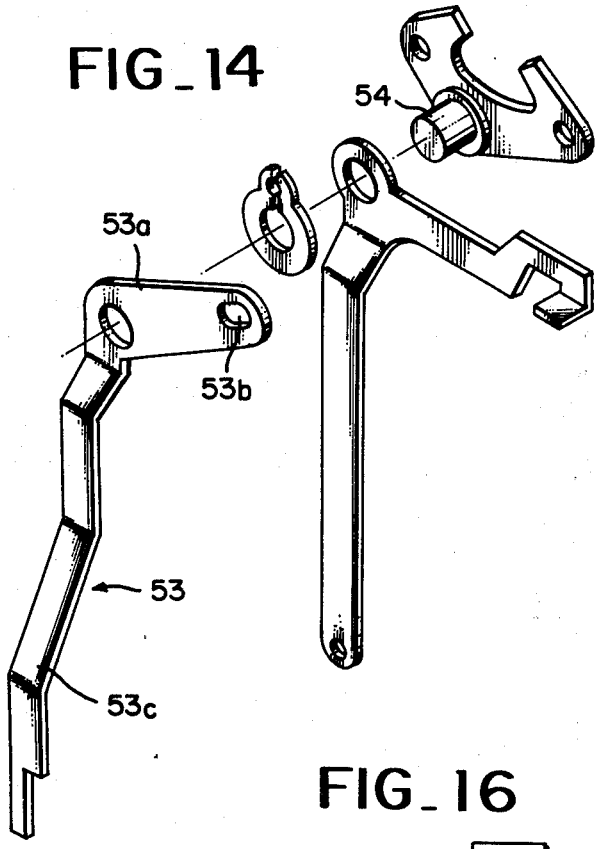
FIG. 14 shows a perspective view of a switching plate of the above.

FIG. 7 shows a block diagram. An output from a pattern selecting device, that is, a signal issued by operation of a pattern selector 17 is routed to an input of a control circuit such as a microcomputer or LSI, and which functionally operates according to the flow chart shown in FIG. 8), and an output of the control circuit is routed to an input of a driving circuit for driving pulse motor 19. The functioning of this first embodiment will be explained with reference to the flow-chart in FIG. 8. The explanation begins with a case in which a pattern selection is made by operating a pattern selector 17, and (CPU) reads out a control signal from (ROM) and a command for a "straight stitch" is issued. To determine whether a new stitch is different from a previous stitch the sewing machine is first rotated at a low speed, and the position of an upper shaft (not shown) can be used to confirm that needle 7 is above needle plate 34 since in order to laterally swing needle 7, it must be above needle plate 34. Pulse motor 19 is then driven by a signal from the control circuit and link 20 is rotated counterclockwise against spring 10 by $\beta°$ from an original position L in which original position needle bar 6 is located at the left basic line as shown in FIG. 9 (A) and FIG. 9 (B). In this case, needle bar supporter 4 and needle bar 6 do pass by left stop 15, and connecting plate 8 only rotates clockwise around pin 9. When pin 21 comes to position $L_1$, engagement between the front end of segment 20a and pin 27a ceases. Pin 27a slides down along the left side of segment 20a and the two are held together by tension spring 24.

When pulse motor 19 rotates in reverse from this state and link 20 rotates clockwise until needle bar 6 reaches the central position of its lateral range, namely, a position M (FIG. 9 (C) (in which needle bar 6 is located at middle basic line), engaging piece 26 engaging the left side of the segment 20a via pin 27a rotates counterclockwise around pivot shaft against the pressure of tension spring 24. Thus auxiliary plate 35 slides towards elongated needle hole 34a via movement of switching plate 22, intermediate lever 30 and switching lever 32, whereby elongated needle hole 34a is covered by auxiliary plate 35 and the shape of the needle hole in needle plate 34 is effectively changed to a semicircular needle hole 35a located in auxiliary plate 35. Thus, needle bar 6 is set to the middle basic line, and needle hole in needle plate 34 is set to correspond with straight stitches. The control circuit then registers the change from zigzag stitching to straight stitching, and the process begins once again.

If the same stitch is again selected, the relationship between position of needle bar 6 and the needle hole in needle plate 34 is the same, since the previous stitch was straight. Pin 21 thus is positioned at point M, and therefore the pulse motor 19 does not change needle position. The sewing machine is then accellerated from low speed operation to high speed operation. As long as straight stitching is selected, the routine will be repeated.

If a different stitch is selected, that is, if the machine is to be reset to zigzag stitching again, it is first confirmed that the sewing machine is operating at low speed and that needle 7 is above needle plate 34. After such confirmation, pulse motor 19 is driven by the signal from the control circuit, and link 20 is rotated in clockwise direction until pin 21 reaches a position R (FIG. 9 (D) in which needle bar 6 is moved to the right basic line. The left end of engaging piece 26 is then pushed forwardly against compression spring 28 by the oblique portion 29a of the releasing piece 29 and is lifted by a distance of "a" and engaging piece 26 moves until pin 27a meets segment 20a. Then, engaging piece 26 is rotated clockwise around the pivot shaft 23 by tension spring 24, and pin 27a can once again engage segment 20a under the influence of compression spring 28 (shown as a hidden line in FIG. 9 (D)). Concurrently, auxiliary plate 35 slides to its original position switching plate 22, intermediate lever 30 and switching lever 32, whereby the needle hole of needle plate 4 is effectively changed to the elongated needle hole 34*a*. Thus, the needle hole of needle plate 34 is set for zigzag stitching. This change is then registered, and needle bar 6 is returned to its original position. As long as zigzag stitching is selected, the sewing machine is set to operate at high speed, pulse motor 19 is disengaged from the needle hole mechanism and the only needle swinging mechanism is driven.

A second embodiment of the invention will be explained with reference to FIGS. 10–17. Block 38 is secured to an arm frame. Pulse motor 39 (which is fixed to block 38) is one example of an electric driving device for swinging the needle 7. A screen 40 and an amplitude link 41 are fixed to shaft 39*a* of pulse motor 39, and a pin 42 fixed to amplitude link 41 supports an end of amplitude rod 43. Accordingly, needle swinging is carried out by transmitting a pattern signal from a memory (not shown) to a driving circuit (not shown) for pulse motor 39 to rotate the shaft 39*a* and thus swing the needle. A recess 41*a* is formed at a left side of amplitude link 41.

An electromagnetic clutch solenoid 42 is fixed parallel to pulse motor 39 by being attached to furnishing plate 43, which latter is secured to block 38. Numeral 44 designates the plunger of solenoid 42, and numeral 45 identifies a switching shaft for switching a needle hole in needle plate 34. Switching shaft is mounted in a bushing 46 (which is secured to block 38) and has flange 45*a* at one end. Switching shaft 45 is axially moved together with solenoid plunger 44 because connecting plate 48 is retained in slit 45*b* (formed opposite flange 45*a* on switching shaft 45) and in a slit 44*a* (formed in one end of solenoid plunger 44) by pins 47. Switching shaft 45 is restrained in leftward movement by collar 49 which encircles its right end.

Numeral 50 is a switching arm which extends over block 38 and is mounted on bushing 46, and switching arm 50 is pushed towards flange 45*a* by a compression spring 51 mounted on bushing 46 between left side wall 50*a* and block 38. Flange 45*a* is relieved to a depth "a", measured from the left end of bushing 46. Notch 50*b*, formed in left side wall 50*a* of switching arm 50, can engage pin 46*a* which is provided on bushing 46. Switching pin 52 is located at an extension of left side wall 50*a*, and the pin 52 can engage recess 41*a* of amplitude link 41.

A switching plate 53 in the shape of a reversed L is attached to pivot shaft 54, which latter is secured to block 38. An oblong hole 53*b* formed at an end of a horizontal piece 53*a* (which is part of plate 53) receives pin 50*c*, which is located at a center part of left side wall 50*a*. Tension spring 55 is arranged between horizontal plate 53*a* and plate 56 which is secured to block 38. Tension spring 55 is arranged between horizontal plate 53*a* and plate 56 which is secured to block 38. Tension spring 55 serves to rotate switching plate 53 clockwise around pivot shaft 54. A stop 57 is secured to block 38 to limit movement of switching plate 53.

Figure 16:
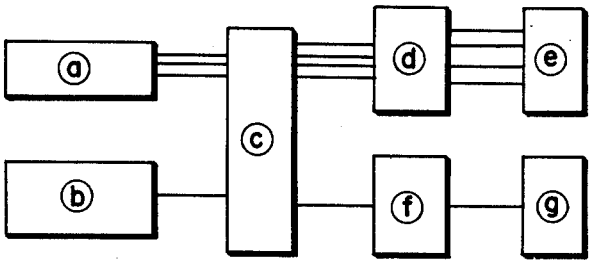
FIG. 16 shows a block diagram of a control circuit for the second embodiment of the invention.
Figure 18:
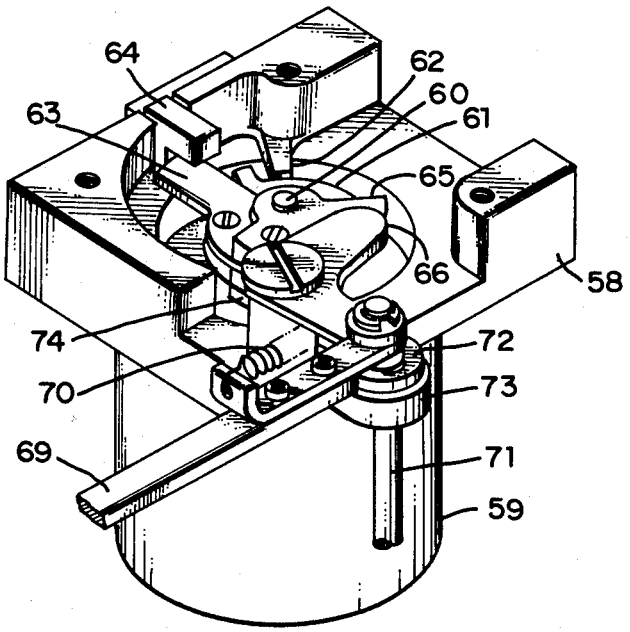
FIG. 18 shows a perspective view of a third embodiment of the invention.

FIG. 16 shows a block diagram of the control system used in this second embodiment. An output from a pattern selecting device, that is, a signal operated by operation of a pattern selector 17 is routed to an input of a control circuit (such as a microcomputer or LSI, and which functionally operates according to the flow chart shown in FIG. 17), and a part of the control circuit functions to control pulse motor 39 to move a control mechanism in synchronism with rotation of an upper shaft of an ordinary sewing machine for swinging the needle bar. Detailed explanation thereof is omitted.

The output of the control circuit is connected to inputs of the pulse motor driving circuit and of the clutch solenoid driving circuit to drive pulse motor 39 and clutch solenoid 42, respectively.

The operation of this second embodiment will refer to the flow chart in FIG. 17. Reference will initially be made to a case where a straight stitch is selected by operating a pattern selector disposed within the pattern selecting device, so that (CPU) reads out a control signal from (ROM) and an order of "Straight Stitch" is issued. To determine whether this straight stitch is different from a previous stitch, i.e. to determine if a previously selected stitch was a zigzag stitch, the sewing machine is first rotated at low speed, after which clutch solenoid 42 is energized. Then, switching arm 50 is moved in a direction shown by arrow P in FIG. 15 via solenoid plunger 44 along switching shaft 45 against compression spring 51. After position of an upper shaft (not shown ) indicates that needle 7 is above needle plate 34 as the necessary prerequisite for needle movement, pulse motor 39 is driven by a signal from the control circuit such that recess 41*a* of amplitude link 41 is positioned at the leftmost end in its turning range, causing needle bar 6 to move to the rightmost end of the needle range, (that is, the right basic line) via amplitude rod 43. At this position, recess 41*a* of the amplitude link 41 engages notch pin 52 to rotate amplitude link 41 and switching arm 50. At the same time, the engagement between the engaging pin 46*a* and notch 50*b* ceases.

When pulse motor 39 subsequently reverses to position notch 41*a* of the amplitude link 41 at the center of lateral needle range, needle bar 6 will thus move via amplitude rod 43 to the center basic line. This rotation causes amplitude link 41 and switching arm 50 to rotate slightly clockwise around bushing 46 since the clutch is engaged, and auxiliary plate 35 slides towards elongated needle hole 34*a* via switching plate 53 intermediate lever 30 and switching lever 32. Therefore, elongated needle hole 34*a* is covered by auxiliary plate 35 and the shape of the needle hole of needle plate 34 is effectively changed to a semicircular needle hole 35*a*. Thus, needle bar 6 is set at the middle basic line and the needle hole of needle plate 34 is set to correspond to straight stitching. The control circuit then registers the change from zigzag stitching to straight stitching, and the process begins once again.

If the same stitch is again selected, the relationship between needle position and the needle hole in needle plate 34 is the same, since the previous stitch was straight. Thus, recess 41*a* of the amplitude link 41 may be retained at the middle of its turning range, and pulse motor 39 therefore does not change needle position. The sewing machine is then accelerated from low speed to the high speed. The clutch solenoid 42 is not needed and it is thus deenergized. In this case, engaging pin 46*a* of bushing 46 is not located in notch 50*b*, so switching arm 50 is limited in leftward movement by pin 46*a* even when clutch solenoid 41 is deenergized. Therefore the amplitude link 41 and the switching arm 50 are still connected to the clutch. Needle bar 6 and needle hole in needle plate 34 are adjusted for straight stitching by keeping amplitude link 41 at its middle position. As long as a straight stitch is selected, the above routine is repeated.

When a zigzag stitch is subsequently selected, it is first confirmed that the sewing machine is operating at low speed and that the needle is above the needle plate (clutch solenoid 42 is already off), after which confirmation pulse motor 39 is driven by the signal from the control unit to rotate the amplitude link 41 such that its recess 41*a* is positioned at its leftmost extreme. Then, switching arm 50 rotates slightly counterclockwise around bushing 46, and auxiliary plate 35 is moved via switching plate 53, intermediate lever 30 and switching lever 32, to effectively change the shape of the needle hole in needle plate 34 to elongated needle hole 34*a*. At the same time, switching arm 50 moves toward flange 50*b* by expansion of compression spring 51. Recess 50*b* can then engage pin 46*a* of bushing 46 and the engagement between notch 41*a* switching pin 52 can then be released, to disengage link 41 and switching arm 50. Thus, the needle hole of needle plate 34 is set for zigzag stitching in elongated needle hole 34*a*. The change from straight stitching to zigzag stitching is registered, and needle bar 6 is returned to its original position. As long as zigzag stitching is selected the sewing machine is operated at high speed, and pulse motor 39 is separated from the needle hole control mechanism so that only the needle swinging mechanism is driven.

Figure 19:
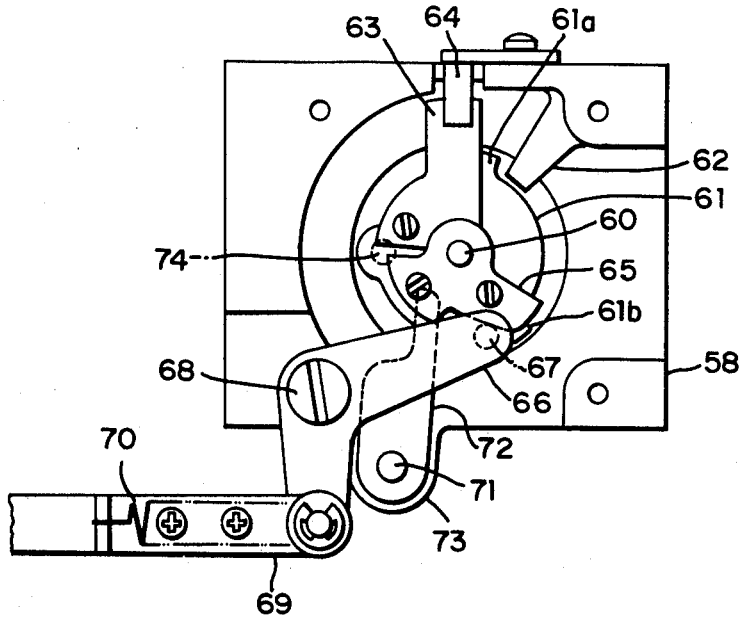
FIGS. 19 and 20 show front views of this third embodiment of the invention, illustrating different states thereof.

The third embodiment of the invention will be explained with reference to FIGS. 18–22. A body 58 is attached to a sewing machine. A pulse motor 59 is attached to body 58. A bed plate 61 is mounted perpendicular to axis 60 of pulse motor 59, and is convex at regions 61*a* and 61*b* (as seen in FIG. 19) so that bed plate 61 is limited in its range of rotation by limiting portion 62 provided on body 58. A screen 63 is fixed to the bed plate 61 for cooperating with a photointerrupter 64 which is fixed to body 58 at a position shown in FIG. 18 or FIG. 19, to thereby generate a signal indicating position of pulse motor 59.

Figure 21:
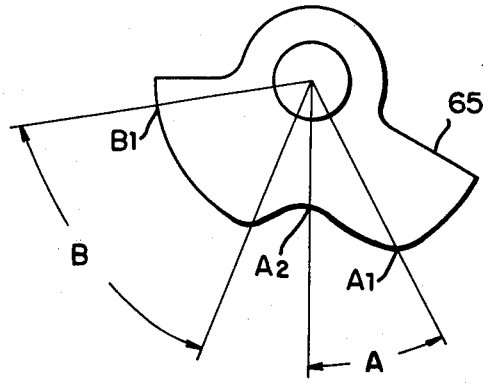
FIG. 21 shows a cam in detail of the above.

A needle cam 65 is fixed to bed plate 61. As is shown in FIG. 21, cam 65 has an angular region A for controlling needle swing and an angular region B for switching the needle hole. Cam 65 is engaged with engaging pin 67 attached to an L-shaped pivoted lever 66 for controlling lateral swinging of the needle. Lever 66 is pivoted by a screw 68 for moving swinging rod 69 shown in FIG. 19. A spring 70 pulls lever 66 counterclockwise to cause engaging pin 67 to ride on cam face 65. When engaging pin 67 is positioned at location $A_1$ in FIG. 21, swinging rod 69 swings maximally left, and when engaging pin 67 is positioned at location $A_2$ swinging rod 69 swings maximally right, so that the needle of the sewing maching is swung maximally left and maximally right, respectively. When the engaging pin 67 is positioned at region B, it serves to keep the needle at a central position. An axle 71 is fixed switching lever 72 and is pivotable on boss 73, so that the needle hole may be switched. The switching lever 72 is urged counterclockwise by a spring (not shown) and is positioned as shown in FIG. 19 by a stop (not shown). Bed plate 61 is provided with a pin 74 for switching the needle hole and when pin 74 strikes switching lever 72 due to counterclockwise rotation of bed plate 61 lever 72 is rotated clockwise. Cam 65 is so arranged that the rotational position of bed plate 61 is within cam region B.

Figure 20:
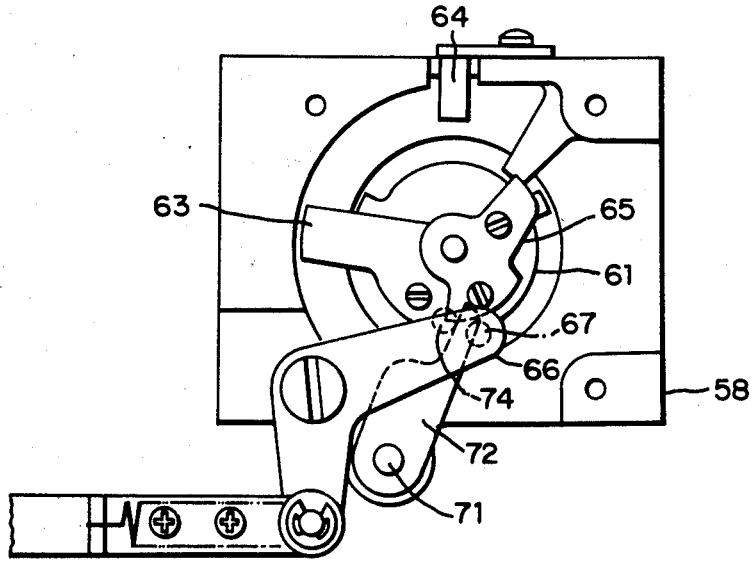

FIG. 20 illustrates that when switching pin 74 rotates switching lever 72 clockwise, pin 67 is located within region B of cam 65 to keep the needle at the middle of its lateral range of motion.

FIG. 20 illustrates that pulse motor 59 rotates almost maximally counterclockwise for forming straight stitches and although the needle plate 34 is not shown, it shows the position in which lever 72 adjusts the needle hole for straight stitching. Here pulse motor 59 is kept stationary for straight stitching. In the position shown in FIG. 19, the needle hole is set for zigzag stitching. The position of screen 63 relative to bed plate 61 is so determined that the resetting position of the pulse motor 59 is located where pin 67 comes to the cam face ($A_1$) of the cam, where the needle swings maximally laterally.

Figure 22:
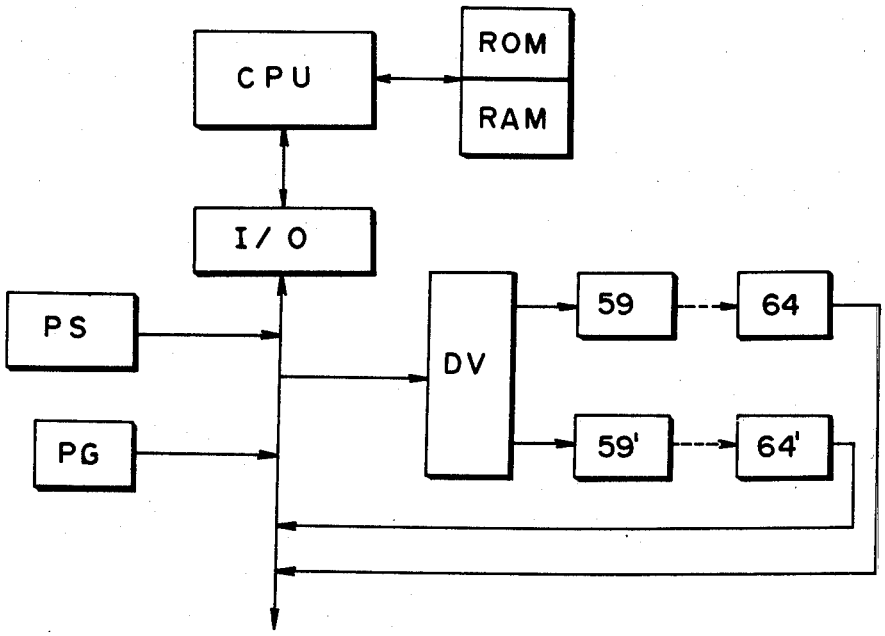
FIG. 22 shows a block diagram of a control circuit.

FIG. 22 is a block diagram, in which solid arrows show relations and directions of electric signal, and phantom arrows show mechanical relations. (ROM) is an electric memory for exclusively reading out memorizing a plurality of stitched pattern control signals (including straight stitches) and program control signals. (CPU) is a central processing unit for controlling each of the programs. (RAM) is a read-write memory for temporarily storing processes and results thereof during execution of the programs. I/O is an input and output port. (PS) is a pattern selector which stores in (RAM) results of selecting desired patterns by switches (not shown) provided at the head of the sewing machine. (PG) is a pulse generator for an upper shaft of the sewing machine, which issues pulses in synchronism with rotation of the upper shaft of the sewing machine and gives a pulse signal to (CPU) for reading out a stitching signal from a (ROM). (DV) is an electric driving device for controlling lateral needle swing and fabric feed, and drives pulse motor 59 to control needle swing and pulse motor 59' for controlling fabric feed in accordance with signals from (CPU). Reference numerals 64 and 64' are photo-interrupters generating pulse signals using the screens (of which one is shown at numeral 63 in FIG. 18) which rotate together with their pulse motors 59 annd 59', the signals being sent to (CPU) as resetting signals for pulse motors 59 and 59'.

In this third embodiment, when a control source is turned on, the control circuit in FIG. 22 is energized. When screen 63 is not blocking photo-interrupter 64, pulse motor 59 rotates to be reset to the position shown in FIG. 19. This rotation is carried out after (CPU) confirms that the needle is near its upper dead point by reading the signal of the upper shaft pulse generator (PG). Since the pin 74 for switching the needle hole does not touch switching lever 72 in this position, lever 72 is rotated maximally counterclockwise, and the needle hole (not shown) is therefore elongated for zigzag stitching, and the engaging pin 67 for controlling needle swing is within the region A of cam 65. When a pattern calling for needle swing is selected by operation of the pattern selector (PS), such a pattern can thus be stitched, (CPU) receives a signal from upper shaft pulse generator (PG) and reads out a stitch control signal from memory (ROM) once stitch to cause driving device (DV) to control rotation of pulse motors 59 and 59'. Since cam 65 does not exceed region A driving needle swinging, needle hole switching lever 72 therefore does not rotate, and the needle hole is kept elongated for zigzag stitching without causing the needle to be broken. When the straight stitch is selected by the pattern selector (PS), central processing unit (CPU) uses the program control signal stored in (ROM) and causes pulse motor driving device (DV) to rotate pulse motor (59 in this case) to rotate switching lever 72 clockwise to reduce the needle hole for straight stitching. Then, engaging pin 67 rides in region B of the cam face, and swinging rod 69 keeps with in the center of the needle hole to protect the needle from breakage. The reduction of the needle hole for straight stitching is completed when engaging pin 67 reaches $B_1$ on cam 65, and this reduction is retained by balancing the pulse motor 59 enabling straight stitching to continue. The switch to straight stitching is accomplished by confirming that the needle is at its upper dead point at the time of resetting. The control of lateral needle swing and the needle hole size has been explained with reference to FIG. 18 followings and in this invention the same structure may be employed for manual stitching by using motor 59' for controlling fabric feed and by sinking the fabric feed control and the feed dog under the needle plate. It is further possible to locate a lever similar to switching lever 72 at another position for providing another function, for example, thread cutting. In such a case, it is necessary to prepare a third region on cam 65 in addition to regions A and B.

According to the present invention, the mechanism of the needle hole in the needle plate is controlled by the electric driving device which is driven by the operation of the pattern selector disposed within the pattern selecting device. Operation is very easy and convenient. Control is carried out when the needle is above the needle plate. The lateral swinging of the needle bar and the switching mechanism of the needle hole of the needle plate are simultaneously by means of the electric driving device for causing lateral movement therefore the needle and needle plate do not interfere with each other at all.

Since the electric driving device is driven at the low speed, the needle hole switching mechanism may be moved for a relatively long period of time. Therefore the load on the electric driving device which actuates the needle hole mechanism is low enough for working, and the inertia load required at high operating speed of the sewing machine may be neglected, the electric driving device is not subject to the total of the inertia load and the working load.

Further, the relation between the electric driving device and the needle dropping hole switching mechanism is governed by the amplitude link mounted on the electric driving device and an engaging piece which is integrally engaged with the amplitude link when it is rotated outside the lateral swinging range. The adjustment of the needle dropping hole is controlled by the switching plate. This control is interrupted by a releasing piece which serves to move the engaging piece axially when rotating the amplitude link to the right basic line of the needle bar. The electric driving device drives the needle bar swing mechanism seperately from the needle hole switching mechanism. Thus, the invention is relatively simple in structure and can be manufactured at a low cost.

The clutch solenoid (which functions as a trigger) does not need to be energized, when the needle hole is adjusted for straight stitching and in this respect energy consumption may be curtailed. Therefore, a small solenoid, not needing a large space and a large control circuit, suffices. In an ordinary mechanism using the solenoid, a relatively large time lag is created between solenoid turnon and its actual movement, and on the other hand a relatively large time lag also exists between solenoid turnoff and actual retraction. Therefore, if the solenoid is used to drive a mechanism which involves a danger of interference between the needle and the needle plate, it is necessary to moniter actual mechanical working with a proper means. However, in the present invention, energization of the solenoid may take place during operation of the pattern selectors and independantly of the phase of the pulse motor, and deenergization thereof can take place when the needle hole switching mechanism is switched to the smaller needle hole, so it is no longer necessary to take the time lag into consideration, thereby avoiding needle breakage.

Furthermore, according to the invention, it is possible to control the mechanism which sinks the feed dog under the needle plate. For example, in controlling the needle hole, when the needle is centrally located, it is not possible to reduce the size needle hole, and therefore even if an erroneous signal is issued, there is no danger of breaking the needle. Further the sewing machine is driven safely without the power source, and the device may be incorporated in the block unit.

We claim:

1. An improvement to a sewing machine in which at least two mechanical machine functions are to be made consistent with each other, namely lateral needle movement and needle hole size adjustment, the improvement comprising: a single pulse motor with an output shaft; a mechanical linkage which can be driven by the output shaft and which is connected in a manner that at least two mechanical functions are made consistent with each other when the linkage is so driven; and a clutch cooperating with the shaft and the linkage and having an engaged position and a disengaged position, the clutch operating in a manner that when the clutch is in the engaged position, the linkage is driven by the shaft, and when the clutch is in the disengaged position, the linkage is undriven by the shaft.

2. The improvement defined by claim 1, wherein the clutch includes a solenoid and wherein the clutch is in the engaged position when the solenoid is energized and wherein the clutch is in the disengaged position when the solenoid is de-energized.

3. The improvement defined by claim 1, further including an electronic control system which operates the clutch, whereby patterns stored in the electronic control system may be stitched while said at least two mechanical machine functions are made consistent with each other.

* * * * *